US009721413B2

(12) United States Patent
Dumas et al.

(10) Patent No.: US 9,721,413 B2
(45) Date of Patent: Aug. 1, 2017

(54) WIRELESS ACCESS CONTROL SYSTEM OPERATING IN AUTOMATIC CALIBRATION MODE AND INCLUDING DOOR POSITION BASED LOCK SWITCHING AND RELATED METHODS

(71) Applicant: Unikey Technologies Inc., Orlando, FL (US)

(72) Inventors: Philip C. Dumas, Orlando, FL (US); William Holderness, Winter Park, FL (US); Justin Handville, Largo, FL (US)

(73) Assignee: UNIKEY TECHNOLOGIES INC., Orlando, FL (US)

( * ) Notice: Subject to any disclaimer, the term of this patent is extended or adjusted under 35 U.S.C. 154(b) by 0 days.

(21) Appl. No.: 15/383,594

(22) Filed: Dec. 19, 2016

(65) Prior Publication Data

US 2017/0154485 A1 Jun. 1, 2017

Related U.S. Application Data

(63) Continuation-in-part of application No. 14/981,093, filed on Dec. 28, 2015, now Pat. No. 9,524,601, and (Continued)

(51) Int. Cl.
*G07C 9/00* (2006.01)

(52) U.S. Cl.
CPC ..... *G07C 9/00309* (2013.01); *G07C 2009/00769* (2013.01)

(58) Field of Classification Search
CPC ..... G07C 9/00309; G07C 2009/00769; G07C 9/00111; G07C 9/00007; G07C 9/00571; G07C 2009/00793; G07C 2209/63
(Continued)

(56) References Cited

U.S. PATENT DOCUMENTS 5,820,177 A 10/1998 Moon
5,987,818 A 11/1999 Dabideen
(Continued)

FOREIGN PATENT DOCUMENTS

CN 203795974 U 8/2014
KR 20030083538 A 10/2003
WO 2013024202 A1 2/2013

*Primary Examiner* — Mark Blouin
(74) *Attorney, Agent, or Firm* — Allen, Dyer, Doppelt + Gilchrist, P.A.

(57) ABSTRACT

A wireless access control system may include a remote access device and a lock assembly. The lock assembly may include a lock, a door position sensor, interior and exterior directional antennas, wireless communications circuitry, a touch sensor, and a lock controller. The lock controller may unlock the lock based upon the touch sensor, determine when the door is closed after being opened based upon the door position sensor, and determine whether the remote access device is in an interior or exterior based upon the directional antennas. The lock controller may also lock the lock when the door is closed and when the remote device is in the interior. The controller may operate in an automatic calibration mode to generate adjusted interior and exterior received signal values and, based upon the adjusted received signal values, enable and disable unlocking when the remote access device is in the exterior and interior, respectively.

32 Claims, 6 Drawing Sheets

Related U.S. Application Data a continuation-in-part of application No. 14/882,045, filed on Oct. 13, 2015, now abandoned.

(58) Field of Classification Search
USPC ..... 340/5.61
See application file for complete search history.

(56) References Cited

U.S. PATENT DOCUMENTS 6,615,629 B2 9/2003 Bates et al.
6,720,861 B1 * 4/2004 Rodenbeck ..... G07C 9/00103 340/5.6
7,012,503 B2 * 3/2006 Nielsen ..... G07C 9/00103 340/5.6
7,262,518 B2 8/2007 Nagano et al.
7,336,151 B2 2/2008 Ueda et al.
7,388,467 B2 6/2008 Fisher et al.
7,456,725 B2 * 11/2008 Denison ..... B60R 25/102 340/10.33
7,515,033 B2 4/2009 Roosli et al.
7,548,151 B2 6/2009 Roosli et al.
7,999,656 B2 8/2011 Fisher
8,054,158 B2 11/2011 Nakashima
8,531,269 B2 9/2013 Nagao et al.
8,717,142 B2 5/2014 Nagao et al.
8,937,526 B2 1/2015 Chandler, Jr.
2003/0214384 A1 11/2003 Milo
2006/0164208 A1 7/2006 Schaffzin et al.
2008/0174403 A1 7/2008 Wolpert et al.
2012/0280790 A1 11/2012 Gerhardt et al.
2013/0237193 A1 9/2013 Dumas et al.
2014/0022054 A1 1/2014 Bliding et al.
2014/0049361 A1 2/2014 Ahearn et al.
2014/0049367 A1 2/2014 Ahearn et al.
2014/0049369 A1 2/2014 Ahearn et al.
2014/0292481 A1 * 10/2014 Dumas ..... G07C 9/00111 340/5.61
2014/0340196 A1 11/2014 Myers et al.
2015/0061830 A1 3/2015 Yamane et al.
2015/0070136 A1 3/2015 Kameyama et al.
2015/0116082 A1 4/2015 Cregg et al.
2015/0211259 A1 7/2015 Dumas et al.
2015/0213658 A1 7/2015 Dumas et al.
2015/0213663 A1 * 7/2015 Dumas ..... G07C 9/00571 340/5.31
2016/0086400 A1 * 3/2016 Dumas ..... G07C 9/00007 340/5.61

* cited by examiner

36'

LOCK CONTROLLER

- OPERATE IN AUTOMATIC CALIBRATION MODE TO GENERATE AN ADJUSTED INSIDE AND OUTSIDE RECEIVED SIGNAL VALUES (e.g., ADJUSTED INSIDE AND OUTSIDE RSSI VAUES) RECEIVED RESPECTIVELY BY THE INSIDE AND OUTSIDE DIRECTIONAL ANTENNAS RESPONSIVE TO TRANSMISSIONS FROM THE REMOTE ACCESS WIRELESS DEVICE (e.g., BASED UPON A PLURALITY OF PRIOR RECEIVED SIGNALS FROM THE INSIDE DIRECTIONAL ANTENNA, AND A PLURALITY OF PRIOR RECEIVED SIGNALS FROM THE OUTSIDE DIRECTIONAL ANTENNA, TO BE WITHIN RESPECTIVE THRESHOLD LIMIT VALUES, BASED UPON AT LEAST ONE DEFAULT RECEIVED SIGNAL VALUE, AND/OR BASED UPON THE TOUCH SENSOR)
- ENABLE UNLOCKING OF THE LOCK WHEN THE ADJUSTED INSIDE AND OUTSIDE RECEIVED SIGNAL VALUES INDICATE THE REMOTE DEVICE IS OUTSIDE, AND DISABLE UNLOCKING THE LOCK WHEN THE ADJUSTED INSIDE AND OUTSIDE RECEIVED SIGNAL VALUES INDICATE THE REMOTE DEVICE IS INSIDE (e.g., BASED UPON A DIFFERENCE BETWEEN THE ADJUSTED INSIDE AND OUTSIDE RECEIVED SIGNAL VALUES, AND/OR EXCEEDING A THRESHOLD)
- INITIAL CALIBRATION MODE
  - GENERATE THE ADJUSTED INSIDE AND OUTSIDE RECEIVED SIGNAL VALUES BASED UPON A FIRST LEARNING RATE
- SWITCH FROM THE INITIAL MODE TO THE MAINTENANCE MODE AFTER A THRESHOLD NUMBER OF TOUCHES OF THE TOUCH SENSOR
- MAINTENANCE MODE
  - GENERATE THE ADJUSTED INSIDE AND OUTSIDE RECEIVED SIGNAL VALUES BASED UPON A SECOND LEARNING RATE LESS THAN THE FIRST LEARNING RATE
- MANUAL CALIBRATION MODE RESPONSIVE TO THE MANUAL CALIBRATION SWITCH
- SELECTIVELY TOGGLE THE INSIDE AND OUTSIDE DIRECTIONAL ANTENNAS TO THE WIRELESS COMMUNICATIONS CIRCUITRY
- RECEIVE AUTHENTICATION DATA ALONG WITH SIGNALS RECEIVED RESPECTIVELY BY THE INSIDE AND OUTSIDE DIRECTIONAL ANTENNAS RESPONSIVE TO TRANSMISSIONS FROM THE REMOTE ACCESS WIRELESS DEVICE

FIG. 5

WIRELESS ACCESS CONTROL SYSTEM OPERATING IN AUTOMATIC CALIBRATION MODE AND INCLUDING DOOR POSITION BASED LOCK SWITCHING AND RELATED METHODS

RELATED APPLICATIONS

The present application is a continuation-in-part of U.S. patent application Ser. No. 14/981,093 filed on Dec. 28, 2015, and is a continuation-in-part of U.S. patent application Ser. No. 14/882,045 filed on Oct. 13, 2015, the entire contents of both are herein incorporated in their entirety by reference.

TECHNICAL FIELD

The present disclosure is directed to the field of electronics, and more particularly, to wireless access control and related methods.

BACKGROUND

Protecting or securing access to an area may be particularly desirable. For example, it is often desirable to secure a home or business. One way of securing access to an area is with a mechanical lock. A mechanical lock typically accepts a key, which may move a deadbolt or enable a door handle to be operated.

It may be desirable to increase user convenience with respect to a mechanical lock. A passive keyless entry (PKE) system may provide an increased level of convenience over a standard lock and key, for example, by providing the ability to access a secure area without having to find, insert, and turn a traditional key. For example, a user may access a secure area using a remote access device, such as, for example, a FOB or mobile wireless communications device. In a PKE system, access may be provided to the secure area without pressing a button or providing other input to the remote device, thus making it passive.

U.S. Patent Application Publication No. 2014/0340196 to Myers et al. discloses an access control system via direct and indirect communications. More particularly, Myers et al. discloses a lock assembly communicating with a mobile device and a gateway to communicate with the lock. Operating commands such as lock and unlock are communicated directly from the mobile device or indirectly after confirming, for example, using GPS coordinates of the mobile device.

U.S. Patent Application Publication No. 2012/0280790 to Gerhardt et al. is directed to a system for controlling a locking mechanism using a portable electronic device. More particularly, Gerhardt et al. discloses using a web service to authenticate a portable electronic device, detecting the proximity of the portable electronic device to the lock, and issuing a command for receipt by the lock from the web service or portable electronic device.

U.S. Patent Application No. 2006/0164208 to Schaffzin et al. is directed to a universal hands free key and lock system. A universal key that transmits an ID to a lock unit. The lock unit has a range limited reader. The lock unit detects the transmitted ID and based thereon operates the lock.

SUMMARY

A wireless access control system may include a remote access wireless communications device and a lock assembly to be mounted on a door remotely from the remote access wireless communications device. The lock assembly may include a lock switchable between locked and unlocked positions, a door position sensor, interior and exterior directional antennas, lock wireless communications circuitry coupled to the interior and exterior directional antennas, a touch sensor, and a lock controller coupled to the lock, the door position sensor, the lock wireless communications circuitry, and the touch sensor. The lock controller may be configured to unlock the lock based upon the touch sensor to permit a user to open the door, determine when the door is closed after being opened based upon the door position sensor, and determine whether the remote access wireless device is in an interior area or an exterior area based upon the interior and exterior directional antennas. The lock controller may also be configured to switch the lock to the locked position when the door is closed and when the remote access wireless device is determined to be in the interior area, and not switch the lock to the locked position when the door is open.

The lock controller may be further configured to operate in an automatic calibration mode to generate an adjusted interior received signal value and an adjusted exterior received signal value based upon signals received respectively by the interior and exterior directional antennas responsive to transmissions from the remote access wireless communications device. The lock controller may also enable unlocking of the lock when the adjusted interior and exterior received signal values indicate the remote access wireless communications device is in the exterior area, and disable unlocking of the lock when the adjusted interior and exterior received signal values indicate the remote access wireless communications device is in the interior area.

The lock controller may be configured to determine whether the remote access wireless communications device is in the interior area or in the exterior area based upon a difference between the adjusted interior and exterior received signal values, for example. The lock controller may be configured to determine whether the remote access wireless communications device is in the exterior area or in the interior area based upon a difference between the adjusted interior and exterior received signal values exceeding a threshold.

The lock controller may be configured to generate the adjusted interior received signal value based upon a plurality of prior received signals from the interior directional antenna, and generate the adjusted exterior received signal value based upon a plurality of prior received signals from the exterior directional antenna. The lock controller may be configured to generate the adjusted interior received signal value and the adjusted exterior received signal value to be within respective threshold limit values, for example.

The automatic calibration mode may include an initial mode wherein the lock controller is configured to generate the adjusted interior and exterior received signal values based upon a first learning rate, and a maintenance mode wherein the lock controller is configured to generate the adjusted interior and exterior received signal values based upon a second learning rate less than the first learning rate, for example. The lock controller may be configured to switch from the initial mode to the maintenance mode after a threshold number of touches of the touch sensor.

The lock controller may be configured to generate the adjusted interior received signal value and the adjusted exterior received signal value based upon at least one default received signal value. The lock controller may be configured to operate in the automatic calibration mode based upon the touch sensor.

The lock assembly may include a radio frequency (RF) switch configured to permit the lock controller to selectively toggle the interior and exterior directional antennas to the wireless communications circuitry, for example. The lock assembly may include a manual calibration switch, and wherein the lock controller is also operable in a manual calibration mode responsive to the manual calibration switch, for example.

The lock controller may be configured to receive authentication data along with signals received respectively by the interior and exterior directional antennas responsive to transmissions from the remote access wireless device. The remote access wireless device may include a portable housing, remote access wireless communications circuitry carried by the portable housing, and a remote access device controller carried by the portable housing and coupled to the remote access wireless communications circuitry, for example.

The adjusted interior received signal value may include an adjusted interior Received Signal Strength Indicator (RSSI) value, and the adjusted exterior received signal value may include an adjusted exterior RSSI value.

A method aspect is directed to a method of controlling access in a wireless access control system that includes a remote access wireless communications device and a lock assembly to be mounted on a door remotely from the remote access wireless communications device. The lock assembly includes a lock switchable between locked and unlocked positions, a door position sensor, interior and exterior directional antennas, lock wireless communications circuitry coupled to the interior and exterior directional antennas, a touch sensor, and a lock controller coupled to the lock, the door position sensor, the lock wireless communications circuitry, and the touch sensor. The method includes using the lock controller to unlock the lock based upon the touch sensor to permit a user to open the door, determine when the door is closed after being opened based upon the door position sensor, and determine whether the remote access wireless communications device is in an interior area or an exterior area based upon the interior and exterior directional antennas. The method also includes using the lock controller to switch the lock to the locked position when the door is closed and when the remote access wireless communications device is determined to be in the interior area, and not switch the lock to the locked position when the door is open.

The method may also include using the lock controller to operate in an automatic calibration mode to generate an adjusted interior received signal value and an adjusted exterior received signal value based upon signals received respectively by the interior and exterior directional antennas responsive to transmissions from the remote access wireless communications device. The lock controller may be further used to enable unlocking of the lock when the adjusted interior and exterior received signal values indicate the remote access wireless communications device is in the exterior area, and disable unlocking of the lock when the adjusted interior and exterior received signal values indicate the remote access wireless communications device is in the interior area.

BRIEF DESCRIPTION OF THE DRAWINGS

FIG. 5 is a more detailed schematic block diagram of the lock controller of FIG. 4.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout and prime notation is used to indicated like elements in different embodiments.

Figure 1:
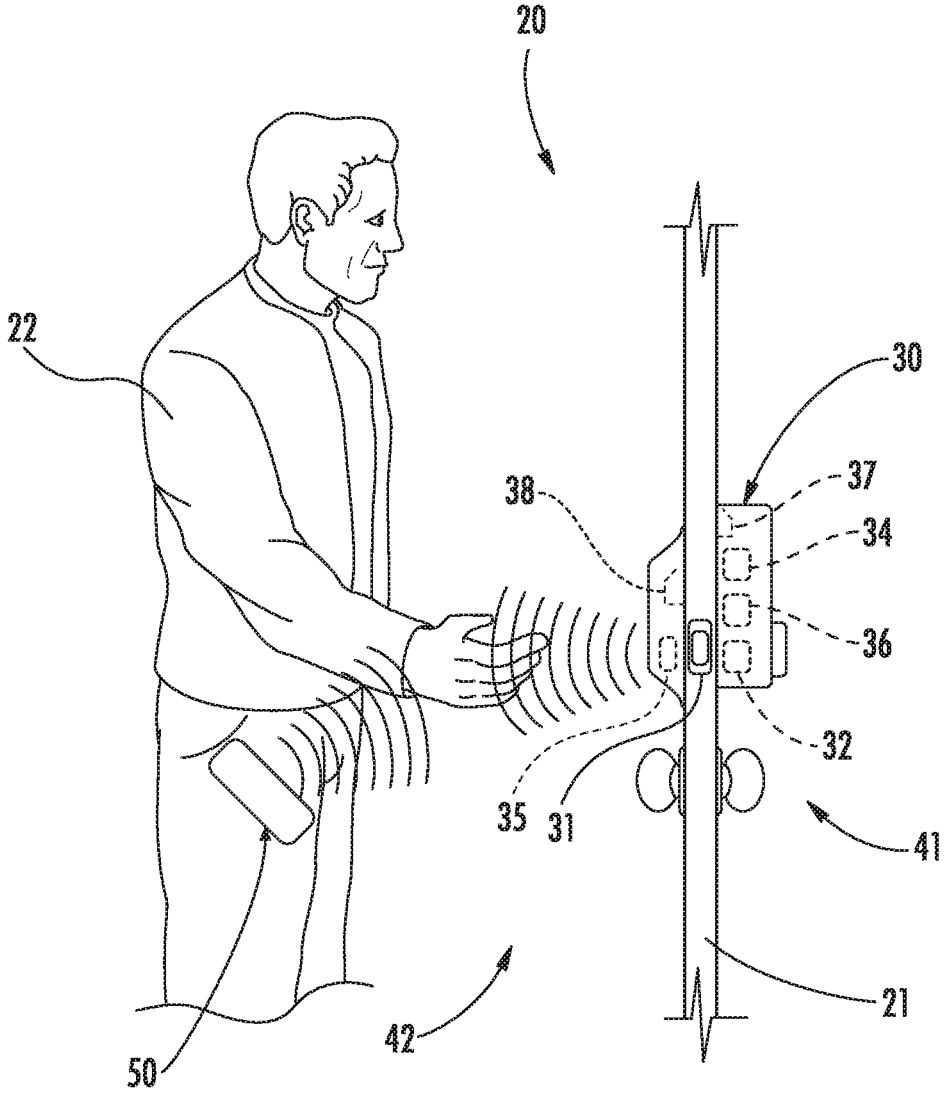
FIG. 1 is a diagram illustrating a side schematic view of a lock assembly of a wireless access control system and a remote access device of the wireless access control system carried by a user in accordance with an embodiment.
Figure 2:
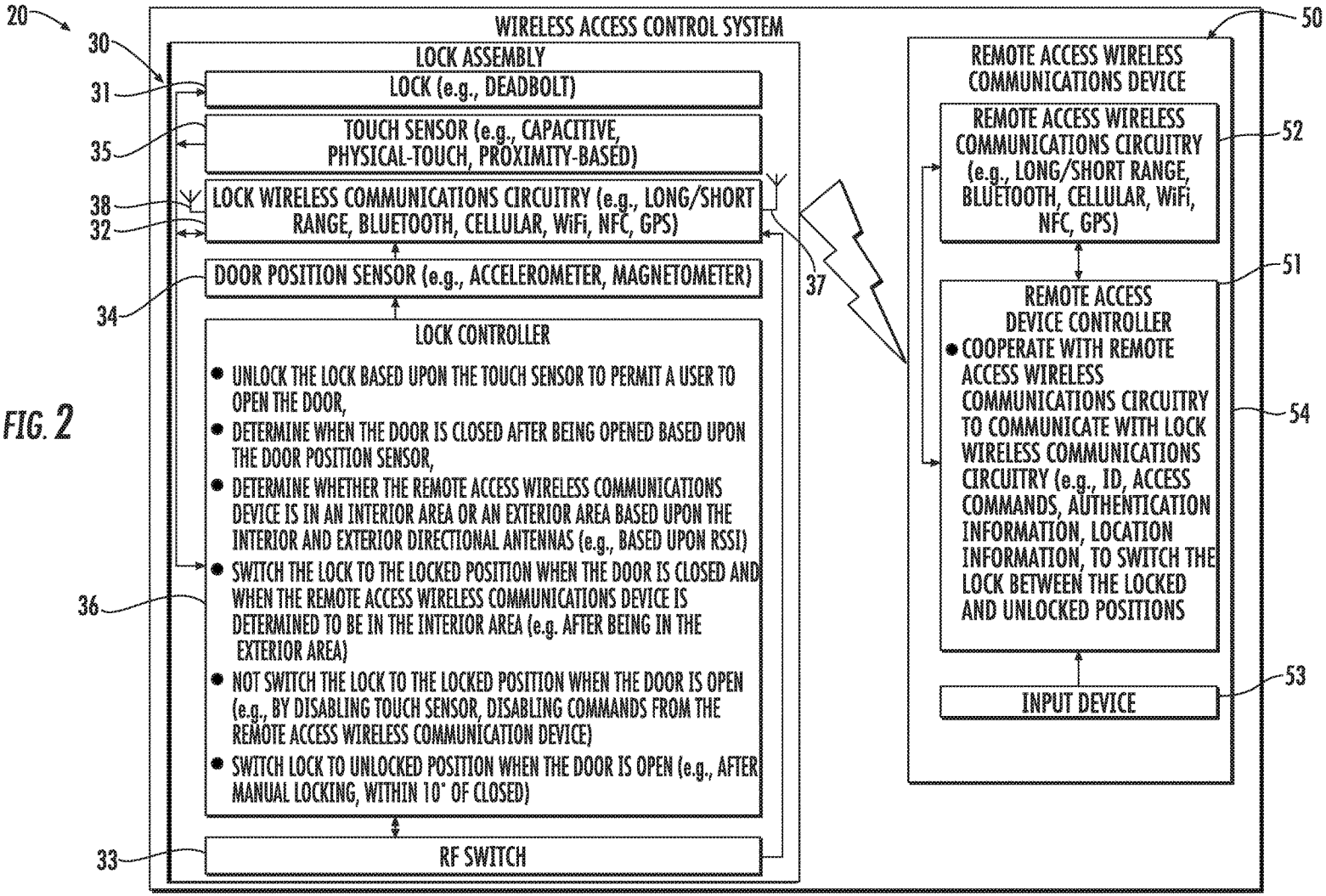
FIG. 2 is a schematic block diagram of the wireless access control system of FIG. 1.

Referring initially to FIGS. 1 and 2, a wireless access control system 20 for a door 21 may include a lock assembly 30 carried by the door. The door 21 may be an interior door, exterior door, overhead garage door, a door to a structure, overhead door, sliding door, screen door, revolving door, for example, a home or business, or any other door that separates an area where protection of that area may be desirable.

The lock assembly 30 may be considered a smart lock and illustratively includes a lock 31 switchable between a locked position and an unlocked position, lock wireless communications circuitry 32, and a door position sensor 34. The lock 31 may be cylinder lock, a deadbolt, or other type of lock, as will be appreciated by those skilled in the art. In some embodiments, the lock 31 may accept a physical key, for example, for manual or key operation of the lock. The lock assembly 30 is illustratively exposed on both the interior and exterior of the door 21. It should be understood that the term interior may refer to the side of the door 21 that faces an area desirable of protection or secured space. For example, where the lock assembly 30 is carried by a door of a home, the interior side 41 is the side within the home, while the exterior side 42 is outside the home and may be accessible to people other than the home's inhabitants.

The lock wireless communications circuitry 32 may be configured to communicate via one or more short range wireless communications protocols, for example, Bluetooth, NFC, WLAN, or other communications protocols. The lock wireless communications circuitry 32 may also communicate via a long range communication protocol, for example, cellular, or global positioning system, or other long range communication protocol. The lock wireless communications circuitry 32 may communicate using either or both of one or more short and long range protocols, as will be appreciated by those skilled in the art.

The lock assembly 30 also includes interior and exterior directional antennas 37, 38 coupled to the lock wireless communications circuitry 32. The interior and exterior directional antennas 37, 38 are pointed or directed to interior and exterior areas 41, 42 respectively. A radio frequency (RF) switch 33 permits the lock controller 36 to selectively toggle the interior and exterior directional antennas 37, 38 to the wireless communications circuitry 32.

The lock assembly 30 also illustratively includes a door position sensor 34. The door position sensor 34 may include an accelerometer, for example. The door position sensor 34 may also include a magnetometer. In some embodiments, the door position sensor 34 may include both an accelerometer and a magnetometer, or other and/or additional devices, sensors, or circuitry configured to sense a position of the door 21. For example, the door position sensor 34 may determine when the door 21 has been opened and/or closed, moved, stationary, etc. A pattern of movement of the door 21 can be determined, for example, opened and then closed, closed then opened, based upon the door position sensor 34.

The lock assembly 30 also illustratively includes a touch sensor 35 on the exterior of the lock assembly 30 to sense touching by a user 22. The touch sensor 35 may be a capacitive touch sensor, for example, and when the lock 31 includes a key hole, may be positioned around the key hole. The touch sensor 35 may be positioned elsewhere on the lock assembly 30. More than one touch sensor 35 may be used. For example, in some embodiments, the lock assembly 30 may include an interior touch sensor and an exterior touch sensor. Other types of touch sensors may also be used. For example, the touch sensor 35 may not necessarily sense touching directly from a user, but rather touching using an intervening object that may be an extension of the user. The lock 31 may be switched between the locked and unlocked positions based upon the touch sensor 35. For example, the user 22 may lock the door 21 by touching the touch sensor 35.

The touch sensor 35 may be a physical-touch sensor for sensing physical contact with the user, for example. The touch sensor 35 may alternatively or additionally be a proximity-based touch sensor configured to sense proximity of the user thereto. In other words, while a touch sensor 35 is described herein, the touch sensor senses either a physical touch of the user or when the user is in a relatively close proximity to the touch sensor, for example, a small distance from the lock assembly 30 (e.g., less than 12 inches), such as by an access card reader, a FOB reader, or other circuitry to sense a user within a relatively small distance from the lock assembly 30 or door 21.

The wireless access control system 20 also illustratively includes a remote access wireless communications device 50 remote from the lock assembly 30. The remote access wireless communications device 50 includes a remote access device controller 51 and remote access wireless communications circuitry 52 coupled to the remote access device controller 51. The remote access device controller 51 and the remote access wireless communications circuitry 52 cooperate to communicate with the lock wireless communications circuitry 32. For example, the remote access device controller 51 and the remote access wireless communications circuitry 52 cooperate to communicate access commands, location information, authentication information, and/or other information for communicating with and controlling operation of the lock 31, and/or other devices that may be included in the wireless access control system 20, as will be appreciated by those skilled in the art. The remote access device controller 51 may also communicate with the lock wireless communications circuitry 32 for switching the lock between the locked and unlocked positions. Similar to the lock wireless communication circuitry 32, the remote access wireless communications circuitry 52 may communicate using one or both of short range and long range communications protocols.

The remote access wireless communications device 50 may be in the form of a fob or keychain, and may include housing 54 carrying a battery for powering the remote access device controller 51 and remote access wireless communications circuitry 52, and at least one input device 53 carried by the housing and coupled to the remote access device controller 51. In other embodiments, the remote access wireless communications device 50 may be a cellular telephone, tablet PC, or any other portable wireless communications device. The lock assembly 30 further includes a lock controller 36 coupled to lock 31, the lock wireless communications circuitry 32, the door position sensor 34, and the touch sensor 35.

Figure 3:
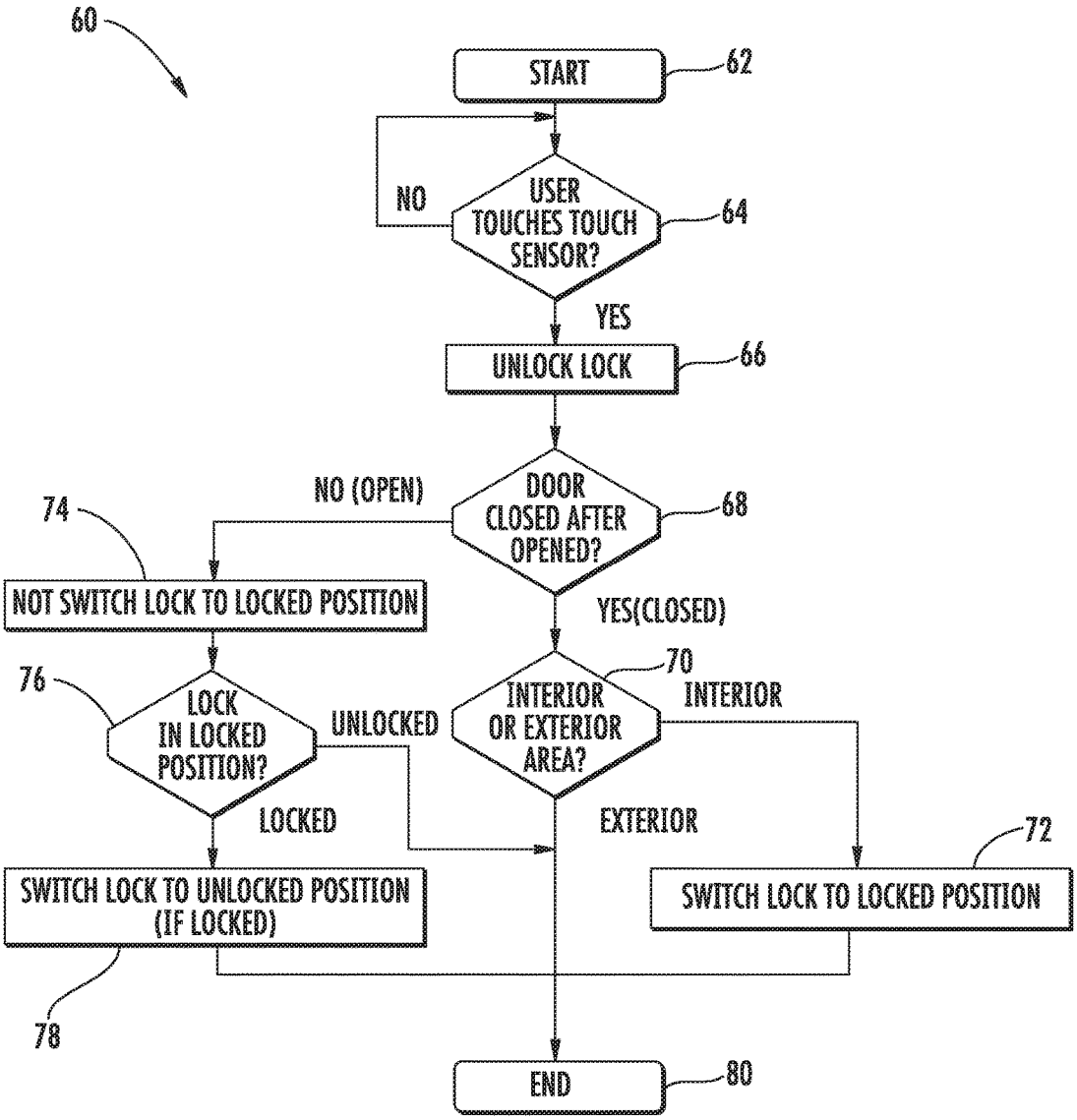
FIG. 3 is a flowchart illustrating operation of the wireless access control system of FIG. 1.

Referring now additionally to the flowchart 60 in FIG. 3, beginning at Block 62, operation of the wireless access control system 20 will also be described. The lock controller 36 is configured to unlock the lock 31 based upon the touch sensor 35 to permit a user 22 to open the door 21. More particularly, the lock controller 36 may switch the lock 31 to the unlocked position (Block 66) based upon the user 22 touching the touch sensor 35 (Block 64).

As will be appreciated by those skilled in the art, during a typical touch-to-unlock operation based upon the touch sensor 35, the lock controller 36 may "wake-up" from a low power mode and begin scanning for an advertising remote access wireless communications device 50. The lock controller 36 may, thereafter, connect with an in-range remote access wireless communications device 50 and determine the identity of the in-range remote access wireless communications device. If the remote access wireless communications device 50 is authorized to access the lock, the lock controller 36 may cooperate with the lock wireless communications circuitry 32 and based upon the interior and exterior directional antennas 37, 38 determine whether the remote access wireless communications device is in the interior area 41 or the exterior area 42. If the user 22 is authorized to access the lock, e.g. at that time, and the remote access wireless communications device 50 is determined to be in the exterior area 42, the lock controller 36 may switch the lock before returning to the low-power mode. It should be noted that it generally takes about 1 to 2 seconds from the time the user 22 touches the touch sensor 35 until the lock is switched.

At Block 68, the lock controller 36 determines when the door is closed after being opened based upon the door position sensor 34. In some embodiments, the lock controller 36 may "wake-up" from a low power mode and begin scanning for an advertising remote access wireless communications device 50 based upon the door position sensor 34 or motion of the door 21. The lock controller 36, at Block 70, also determines whether the remote access wireless communications device 50 is in the interior area 41 or the exterior area 42 based upon the interior and exterior directional antennas 37, 38. The lock controller 36 may determine whether the remote access wireless communications device 50 is in the interior area 41 or exterior area 42 based upon a received signal strength indicator (RSSI) from the interior and exterior directional antennas 37, 38 (e.g. to determine location of or direction of movement of the remote access wireless communications device 50). Of course, the lock controller 36 may determine whether the remote access wireless communications device 50 is within the interior area 41 or exterior area 42 based upon other and/or additional techniques.

When the door is closed (Block 68) and when the remote access wireless communications device 50 is determined to be in the interior area (Block 70), the lock controller 36 switches the lock 31 to the locked position (Block 72). The lock controller 36 may switch the lock 31 to the locked position based upon the expiration of a threshold time period from the close of the door 21.

When the door 21 is open (Block 68), for example, after a threshold time period, the lock controller 36 does not switch the lock 31 to the locked position (Block 74). More particularly, the lock controller 36 may not switch the lock 31 to the locked position by disabling the touch sensor 35 and/or disabling commands received from the remote access wireless communications device 50.

If, the lock 31 is in the locked position (Block 76) and the door 21 is open (Block 68), or more particularly within 10-degrees of closed, the lock controller 36 may switch the lock to the unlocked position (Block 78). The lock 31 may become locked while the door 21 is open, for example, by the user 22 manually switching the lock to the locked position while the door is open. The lock controller 36 may begin switching the lock 31 to the unlocked position at different door-open positions (i.e., within x-degrees of closed), for example, based upon a speed of movement of the door 21. A speed-of-door to door position table may be stored in a memory coupled to the lock controller 36 and used to determine when to initiate the unlocking of the lock 31.

In some embodiments, if the user 22 attempts to operate the lock 31, either via the remote access wireless communications device 50 or via a thumb-turn, for example, the user may receive a notification that the lock cannot be switched because the door 21 is open. The notification may be audible, visual, tactile, or a combination thereof, and may be generated by the remote access wireless communications device 50 and/or the lock assembly through displays, visual indicators, etc., as will be appreciated by those skilled in the art. The method ends at Block 80.

As will be appreciated by those skilled in the art, the wireless access control system 20 may be particularly advantageous in reducing the occurrences of the lock "locking itself" while the door 21 is still open. For example, when a user 22 opens the door 21 and walks through the doorway, the user may accidentally (and sometimes unknowingly) brush up against or come in relatively close proximity to the touch sensor 35 with their arm, elbow, or hand, for example. Upon doing so, the lock controller may execute a "touch event" for example, causing the lock to be switched to the locked position while the door 21 is still open.

Figure 4:
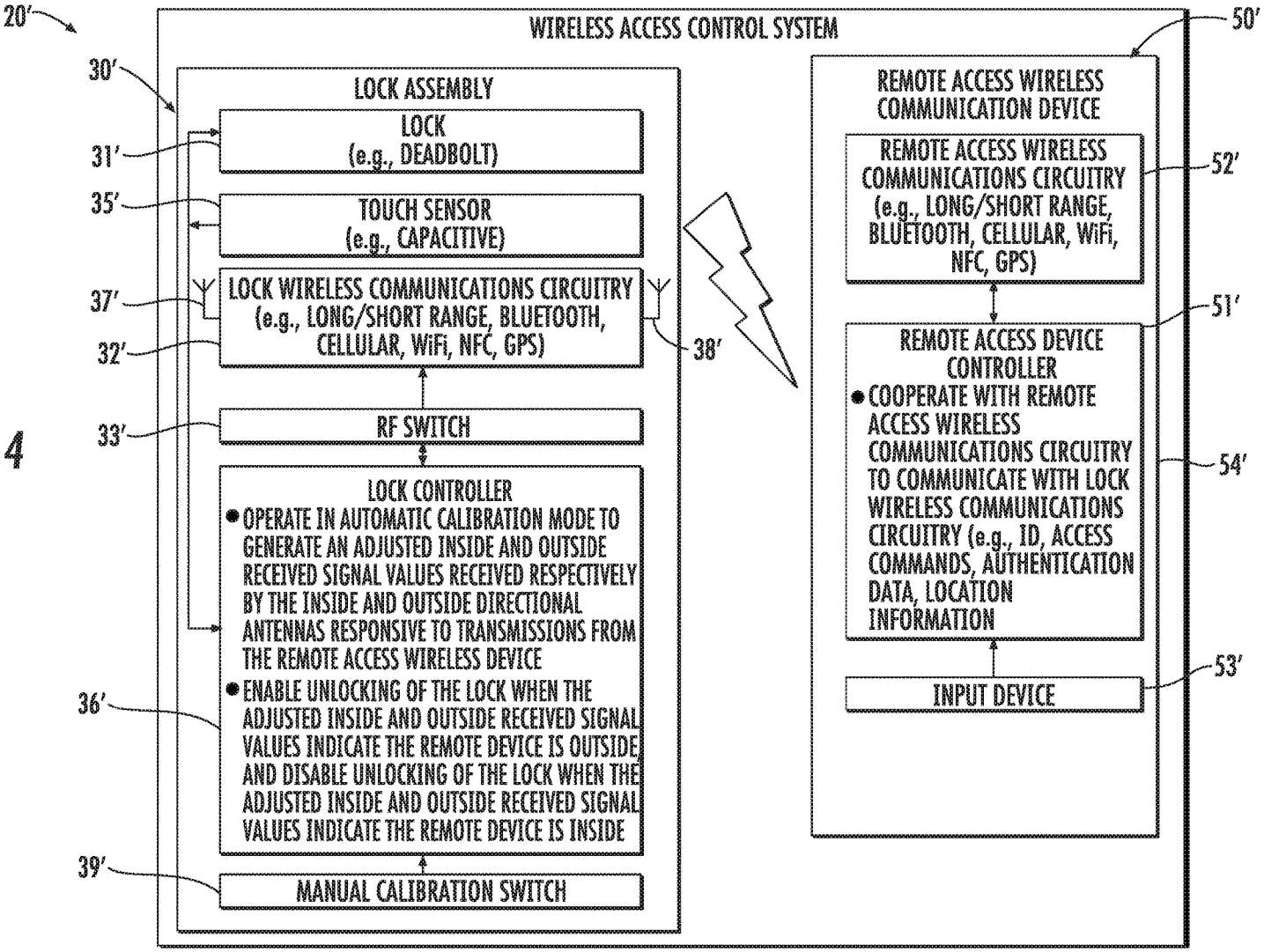
FIG. 4 is a schematic block diagram of a wireless access control system in accordance with another embodiment.
Figure 6:
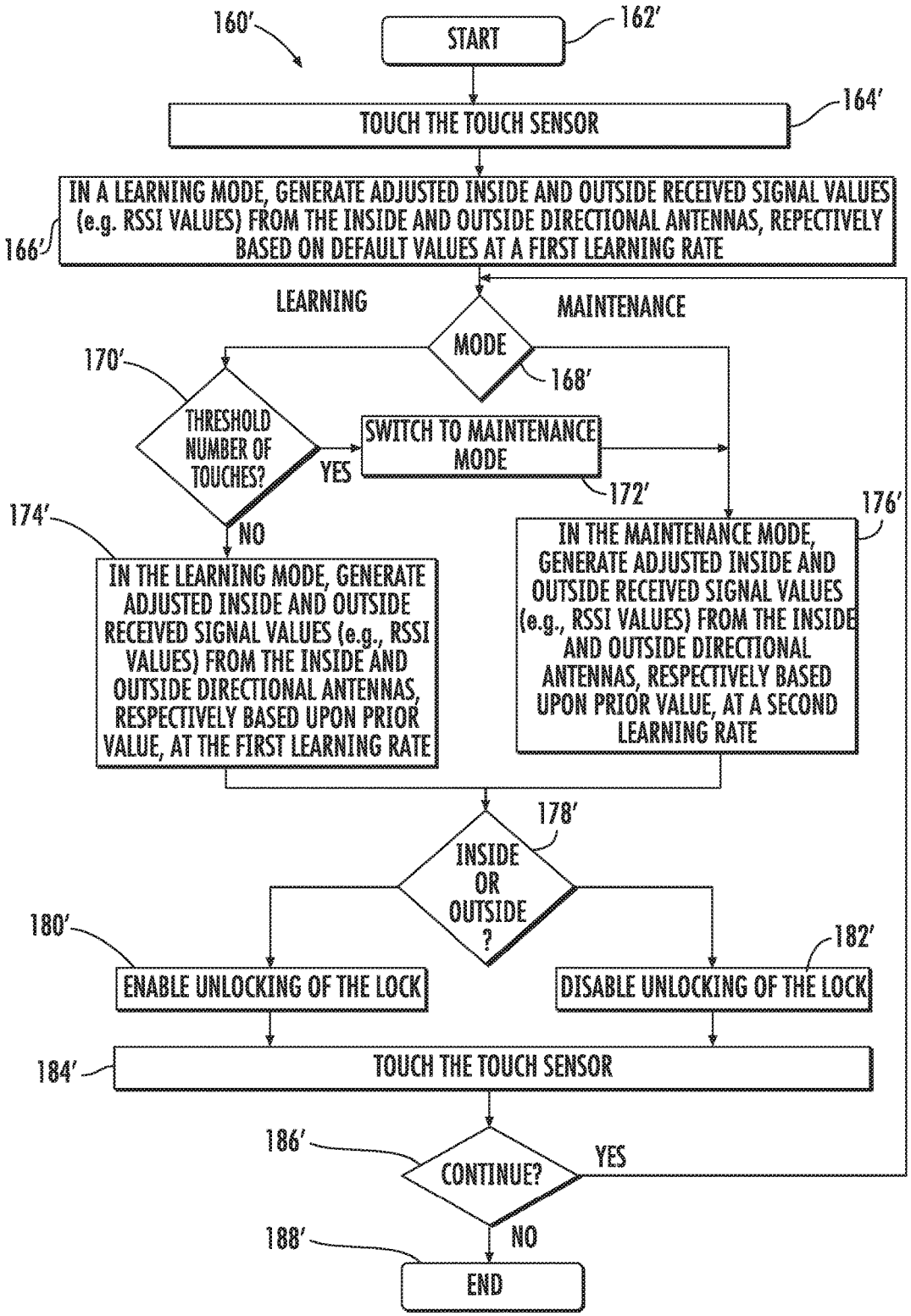
FIG. 6 is a flowchart illustrating operation of the wireless access control system of FIG. 4.

Referring now to FIGS. 4-5 and the flowchart 160' in FIG. 6, in some embodiments, the lock controller 36' may additionally perform an automatic calibration function. Beginning at Block 162', calibration of the lock assembly 30' will now be described. It should be noted that calibration typically includes two checks and is performed on a per-user basis: an inside/outside delta check, and an activation range check. As will be described in further detail below, the inside versus outside determination is calculated by subtracting an adjusted interior or inside RSSI from an adjusted exterior or outside RSSI, and if the calculated delta exceeds a calibrated value, the user is considered to be outside, otherwise, the user is inside. Activation range is measured from the exterior directional antenna 38'. If the adjusted outside RSSI is larger than calibrated value for range, the user is considered out of range, and unlocking of the lock 31' is disabled.

The lock controller 36' operates in one of an automatic calibration mode and a manual calibration mode. In the automatic calibration mode, the lock controller 36' automatically learns where the user 22' typically is based upon RSSI values during each touch-to-open event (i.e., operation of the touch sensor 35' to unlock/lock the lock 31'). During the automatic calibration mode, an assumption is made that most touch-to-open events occur when the user 22' is outside and in a location where they want the lock 31' to open. The auto calibration is based upon the delta rule and gradient descent with some added constraints, as will be described in further detail.

Gradient descent is an iterative method that is given an initial point, and follows the negative of the gradient to move the point toward a reference point. As it is applied the auto calibration mode, an un-calibrated value is used as a starting point, and over many touch-to-open events, the lock controller 36' adjusts the un-calibrated value to move it toward the measure location of the user 22' when they performed touch-to-open. The adjustment to each calibration value is made with the following equation:

$$b=a-\gamma\nabla F(a)$$

where b=New Calibrated Value a=Old Calibrated Value

γ=Learning Rate $\nabla F(a)=a-X_{current}$ $x_{current}$=Current Measured Value Using this formula, a new calibration value is formed by taking a small percentage of the difference between where the user is currently standing and the calibrated value, and applying that difference to the current calibrated value.

More particularly, in the automatic calibration mode, the lock controller 36' generates an adjusted inside received signal value, which includes an adjusted inside RSSI value, and an adjusted outside received signal value, which includes an adjusted RSSI value (Blocks 166', 174', 176'). The adjusted inside and outside received signal values are generated based upon signals received respectively by the interior and exterior directional antennas 37', 38' responsive to transmissions from the remote access wireless communications device 50'. The lock controller 36' determines whether the remote access wireless communications device 50' is outside or inside based upon a difference between the adjusted interior (inside) and exterior (outside) received signal values, for example, exceeding a threshold (Block 178').

The lock controller 36' enables unlocking of the lock 31' when the adjusted inside and outside received signal values indicate that the remote access wireless communications device 50' is outside (Block 180'), and disables unlocking of the lock when the adjusted inside and outside received signal values indicate the remote access wireless device is inside (Block 182').

The controller 36' generates the adjusted inside received signal value based upon prior received signals from the interior directional antenna 37', and generates the adjusted outside received signal value based upon prior received signals from the exterior directional antenna 38' (Blocks 174', 176'). If there are no prior received signals from which to generate adjusted values, the lock controller 36' adjusts a default or starting value, and the adjusted inside and outside received signal values are generated to be within respective threshold limit values (Block 166').

For example, it was determined that the adjusted inside received signal value from the interior antenna 37' should not exceed the adjusted outside signal value from the exterior antenna 38' by more than 5 dBm when the remote access wireless communications device 50' is outside. As a result, −5 dBm was chosen as the initial value for the automatic calibration mode. The number of −5 dBm may be particularly advantageous as it may make the automatic calibration mode more effective in a much faster time frame since it typically does not have adjust a larger difference (e.g. a default value of −80 dBm). Secondly, starting at −5 dBm may allow other devices, for example, server verified keys for operating the lock and non-calibrated devices to operate based upon this inside/outside determination. By setting a more "reasonable" default value, devices inside that are more than a few feet from the door may be able to be flagged as inside for nearly every unlock attempt, for example. A default value for range determination may still be set relatively high, for example, at 85 dBm, to compensate for devices that are in purses or cases.

Further details of the automatic calibration mode will now be described with respect to the flowchart 160' in FIG. 6. In the automatic calibration mode, the lock controller 36' operates based upon the touch sensor 35' (Block 164'), includes an initial mode and a maintenance mode. In the initial mode, the lock controller 36' generates the adjusted inside and outside received signal values based upon a first learning rate, first based upon default values (Block 166') and then based upon prior values (Block 174'). In the maintenance mode, the lock controller 36' generates the adjusted inside and outside received signal values based upon a second learning rate less than the first learning rate (Block 176'). The lock controller 36' switches from the initial mode to the maintenance mode (Block 172') after determining whether there has been a threshold number of touches of the touch sensor 35' (Block 170') in the learning mode (Block 168'). In other words, the lock assembly 30' generally starts in the initial mode until a certain amount of automatic calibration has been performed. Thereafter, when a certain number of samples, for example, have been collected, the lock controller 36' switches to the maintenance mode.

More particularly, in the above equation, the learning rate is used to determine how quickly the calibration values adapt to new RSSI levels. The higher the learning rate, the closer to the new RSSI the calibration moves. Setting the learning rate to 100% would set the new calibration value to exactly where the current received values are. As will be appreciated by those skilled in the art, this may not provide an accurate calibration. However, the lock controller 36' is advantageously able to learn relatively quickly to get a relatively accurate estimation of the calibration of the lock assembly 30' in the first few touches of the touch sensor 35'.

For example, in the initial mode, the learning rate may be set to 50%. After ten (10) touches of the touch sensor 35' in the initial mode, the lock controller 36' switches to the maintenance mode. There are generally no limitations on the learning, as every touch may move the calibrated value (i.e., the adjusted inside received signal value and the adjusted outside received signal value) regardless of whether the adjustment may be considered an improvement or not. Of course, in the initial mode, the learning rate may be set to another rate, and the number of touches of the touch sensor 35' for switching to the maintenance mode may be different.

In the maintenance mode, the learning rate may drop, for example to 1%, and thus the lock controller 36' may be considered to be in a steady-state. In the maintenance mode, it takes many more touches of the touch sensor 35' to make relatively large changes. In other words, changes in user patterns or slow environmental changes are accounted for such as the changing of the seasons or the user changing phone cases or purses. Of course, the learning rate in the maintenance mode may be another rate.

Another determining factor of the learning rate is which way the adjusted inside received signal value and an adjusted outside received signal value (i.e., calibration value) are moving. More particularly, when the lock controller 36' senses loosening of the calibrated values, the lock controller doubles the learning rate for that event, for example. Doubling the learning rate may involve the adjustment of the adjusted inside and outside received signal values thresholds.

Situations when the lock controller 36' learns are now described. For example, in the automatic calibration mode, it may be possible that a malicious user stands on the outside of the lock assembly 30' and continues to touch the touch sensor 35' of the lock assembly until the lock controller 36' unlearns its calibration and allows access to the malicious user. To address this, once the lock controller 36' is in the maintenance learning mode, the lock controller only learns when the adjusted inside and outside received signal values are within a padded calibrated region, for example. While in the initial mode, the lock controller 36' learns based upon each touch of the touch sensor 35'. It should be noted that calibrated region is padded to include room for loosening cases, as well as the inconsistencies of the RSSI values. Through the automatic calibration mode, the decision to let the user inside, and the decisions for how to learn remains separated, which may allow padding to be added to the learning values for example, but not to the determination of inside/outside.

Based upon the foregoing, exemplary events at each touch of the touch sensor 35' may be as follows:

1. User touches the touch sensor 35';
2. The lock controller 36' connects to remote access wireless communications device 50' and begins gathering RSSI data;
3. Once enough RSSI is acquired, the inside and outside antenna measurements are calculated;
4. Using an average inside RSSI and average outside RSSI, a delta value and a range value are calculated;
5. The delta value is checked against the current calibrated delta value to determine if the remote access wireless communications device 50' is inside or outside.
6. The lock controller 36' in the automatic calibration mode decides if the delta value is within the learning region;
   a. If the delta value is within the learning region, padding is applied, and the padded value is used with the current calibrated value in the gradient descent equation to determine a new calibrated value; and
   b. Otherwise, no learning occurs;
7. If the remote access wireless communications device 50' was determined to be outside, the measured range value is checked against the calibrated range value to determine if the device is in range;
8. The lock controller 36' in the automatic calibration mode decides if the measured range is within the learning region for range;
   a. If the measured range is within the learning region, padding is applied, and the padded value is used with the current calibrated value in the gradient descent equation to determine a new calibrated value; and
   b. Otherwise, no learning occurs; and
9. If the remote access wireless communications device 50' is determined to be in range and outside the door 21', the lock controller 36' operates the lock 31' to either lock or unlock.

In order to make sure that the calibrated values can account for the variability of the RSSI values, padding should be added while learning. The following values are applied to the measured values to get the padded values that are used in the gradient descent equation:

$$\text{Padded Range}=+8\text{ dBm}$$

$$\text{Padded } IO=-8\text{ dBm}$$

In some embodiments, padding may not be added. The automatic calibration continues so long as the lock assembly is operational (Block 186') before ending at Block 188'.

The lock assembly 30' also includes a manual calibration switch 39' (FIG. 4). The lock controller 36' is also operable in a manual calibration mode responsive to the manual calibration switch 39'. More particularly, the manual calibration mode or process may be defined as follow:

1. Initiate Calibration in an application, for example, on the remote access wireless communications device 50';
2. Hold the remote access wireless communications device 50' in proximity to the back of the lock assembly 30' and push the manual calibration switch;
3. Replace the back cover of the lock assembly 30';
4. Position the remote access wireless communications device 50' outside, for example, in a front pocket or purse; and
5. Touch the touch sensor 35' three (3) times so that the lock controller 36' can collect RSSI values from where the user 22' is standing.

The lock controller 36' then shows whether or not calibration was successful:

a. If sufficient values are seen on the lock controller 36', a visual indicator will flash green;
b. Otherwise, the visual indictor will flash red and the user must restart the process either from Step 1 or Step 5, depending on the version of the lock controller 36'.

Continuing with respect to the manual calibration mode, the lock controller 36' collects twenty (20) samples each time the user touches the touch sensor 35', ten (10) samples for the outside directional antenna, ten (10) samples for the inside antenna. After collecting each set of samples on the inside and outside, the lock controller 36' determines the average and standard deviation of the samples, then trims out any values that are outside of the standard deviation and re-averages the remaining values. Once three (3) adjusted points are collected, they are then averaged together to get the adjusted inside RSSI value and the adjusted outside RSSI value.

The inside/outside delta is typically equal to the adjusted inside RSSI value−adjusted outside RSSI value. The activation range is set to the adjusted outside RSSI value.

In order for calibration to succeed, the inside/outside delta should be greater than 3.0, and the activation range should be less than 85 dBm. Otherwise manual calibration fails. If an inside/outside delta of −15 dBm or lower is detected, the lock controller 36' generates a message that indicates that the exterior directional antenna 38' and/or cable is likely damaged.

If calibration is successful, before saving the two values, padding is added to compensate for the variability of RSSI values. Padding after calibration is done as follows:

IOS:

$$\text{Padded Range}_{iOS}=\text{Range}+8\text{ dB}$$

$$\text{Padded } IO_{iOS} = \frac{IO}{3} - 3$$

Fob:

$$\text{Padded Range}_{Fob}=\text{Range}+10\text{ dB}$$

$$\text{Padded } IO_{Fob} = \frac{IO}{3} - 2$$

It should be noted that the manual calibration mode may remain intact with the automatic calibration mode. In other words, both modes are selectable for operation regardless of which mode is currently being used. If a user desires to calibrate the lock assembly 30', the manual calibration process still provides that. None of the math or equations may be changed for the manual calibration mode. After performing manual calibration, a user is still pushed into the maintenance mode to allow for small gradual changes, as will be appreciated by those skilled in the art.

Security may not be as much of a concern during locking events as it may be during unlocking events. To address this, the lock controller 36' may include what may be referred to as relaxed locking. Relaxed locking allows for some additional slack during the inside/outside check when the lock controller 36' is performing a lock event. The lock controller 36' adds 2 dBm to the measured delta before it is compared to the calibrated value to help the user have fewer failures while outside. Relaxed locking for inside/outside is forward compatible with the automatic calibration mode and remains unchanged.

In another embodiment, relaxed locking may alternatively or additionally be added to the range check, and may disable range checking on lock events, for example. This may allow a user to touch the touch sensor 35', simply walk away and not wait for the lock controller 36' to complete the inside/outside determination. If this feature is put in place for automatic calibration mode, the lock controller 36' may not learn during lock events since the user might not be in a desired learning location, for example.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A wireless access control system comprising:

a remote access wireless communications device; and a lock assembly to be mounted on a door remotely from said remote access wireless communications device, said lock assembly comprising a lock switchable between locked and unlocked positions, a door position sensor, interior and exterior directional antennas, lock wireless communications circuitry coupled to said interior and exterior directional antennas, a touch sensor, and a lock controller coupled to said lock, said door position sensor, said lock wireless communications circuitry, and said touch sensor;

said lock controller configured to unlock the lock based upon said touch sensor to permit a user to open the door, determine when the door is closed after being opened based upon said door position sensor, determine whether said remote access wireless communications device is in an interior area or an exterior area based upon said interior and exterior directional antennas, switch said lock to the locked position when the door is closed and when said remote access wireless communications device is determined to be in the interior area, and not switch said lock to the locked position when the door is open;

said lock controller further configured to operate in an automatic calibration mode to generate an adjusted interior received signal value and an adjusted exterior received signal value based upon signals received respectively by said interior and exterior directional antennas responsive to transmissions from said remote access wireless communications device, and enable unlocking of said lock when the adjusted interior and exterior received signal values indicate said remote access wireless communications device is in the exterior area, and disable unlocking of said lock when the adjusted interior and exterior received signal values indicate said remote access wireless communications device is in the interior area.

2. The wireless access control system of claim 1 wherein said lock controller is configured to determine whether said remote access wireless communications device is in the interior area or in the exterior area based upon a difference between the adjusted interior and exterior received signal values.

3. The wireless access control system of claim 1 wherein said lock controller is configured to determine whether said remote access wireless communications device is in the exterior area or in the interior area based upon a difference between the adjusted interior and exterior received signal values exceeding a threshold.

4. The wireless access control system of claim 1 wherein said lock controller is configured to generate the adjusted interior received signal value based upon a plurality of prior received signals from said interior directional antenna, and generate the adjusted exterior received signal value based upon a plurality of prior received signals from said exterior directional antenna.

5. The wireless access control system of claim 1 wherein said lock controller is configured to generate the adjusted interior received signal value and the adjusted exterior received signal value to be within respective threshold limit values.

6. The wireless access control system of claim 1 wherein the automatic calibration mode comprises:

an initial mode wherein said lock controller is configured to generate the adjusted interior and exterior received signal values based upon a first learning rate; and a maintenance mode wherein said lock controller is configured to generate the adjusted interior and exterior received signal values based upon a second learning rate less than the first learning rate.

7. The wireless access control system of claim 6 wherein said lock controller is configured to switch from the initial mode to the maintenance mode after a threshold number of touches of said touch sensor.

8. The wireless access control system of claim 1 wherein said lock controller is configured to generate the adjusted interior received signal value and the adjusted exterior received signal value based upon at least one default received signal value.

9. The wireless access control system of claim 1 wherein said lock controller is configured to operate in the automatic calibration mode based upon said touch sensor.

10. The wireless access control system of claim 1 wherein said lock assembly comprises a radio frequency (RF) switch configured to permit said lock controller to selectively toggle said interior and exterior directional antennas to said wireless communications circuitry.

11. The wireless access control system of claim 1 wherein said lock assembly comprises a manual calibration switch; and wherein said lock controller is also operable in a manual calibration mode responsive to said manual calibration switch.

12. The wireless access control system of claim 1 wherein said lock controller is configured to receive authentication data along with signals received respectively by said interior and exterior directional antennas responsive to transmissions from said remote access wireless communications device.

13. The wireless access control system of claim 1 wherein said remote access wireless communications device comprises:

a portable housing;

remote access wireless communications circuitry carried by said portable housing; and a remote access device controller carried by said portable housing and coupled to said remote access wireless communications circuitry.

14. The wireless access control system of claim 1 wherein the adjusted interior received signal value comprises an adjusted interior Received Signal Strength Indicator (RSSI) value, and the adjusted exterior received signal value comprises an adjusted exterior RSSI value.

15. A lock assembly for a wireless access control system comprising a remote access wireless communications device, and a lock assembly to be mounted on a door remotely from the remote access wireless communications device, the lock assembly comprising:

a lock switchable between locked and unlocked positions;

a door position sensor;

interior and exterior directional antennas;

lock wireless communications circuitry coupled to said interior and exterior directional antennas;

a touch sensor; and a lock controller coupled to said lock, said door position sensor, said lock wireless communications circuitry, and said touch sensor;

said lock controller configured to unlock the lock based upon said touch sensor to permit a user to open the door, determine when the door is closed after being opened based upon said door position sensor, determine whether the remote access wireless communications device is in an interior area or an exterior area based upon said interior and exterior directional antennas, switch said lock to the locked position when the door is closed and when the remote access wireless communications device is determined to be in the interior area, and not switch said lock to the locked position when the door is open;

said lock controller further configured to operate in an automatic calibration mode to generate an adjusted interior received signal value and an adjusted exterior received signal value based upon signals received respectively by said interior and exterior directional antennas responsive to transmissions from said remote access wireless communications device, and enable unlocking of said lock when the adjusted interior and exterior received signal values indicate said remote access wireless communications device is in the exterior area, and disable unlocking of said lock when the adjusted interior and exterior received signal values indicate said remote access wireless communications device is in the interior area.

16. The lock assembly of claim 15 wherein said lock controller is configured to determine whether said remote access wireless communications device is in the interior area or in the exterior area based upon a difference between the adjusted interior and exterior received signal values.

17. The lock assembly of claim 15 wherein said lock controller is configured to determine whether said remote access wireless communications device is in the exterior area or in the interior area based upon a difference between the adjusted interior and exterior received signal values exceeding a threshold.

18. The lock assembly of claim 15 wherein said lock controller is configured to generate the adjusted interior received signal value based upon a plurality of prior received signals from said interior directional antenna, and generate the adjusted exterior received signal value based upon a plurality of prior received signals from said exterior directional antenna.

19. The lock assembly of claim 15 wherein said lock controller is configured to generate the adjusted interior received signal value and the adjusted exterior received signal value to be within respective threshold limit values.

20. The lock assembly of claim 15 wherein the automatic calibration mode comprises:

an initial mode wherein said lock controller is configured to generate the adjusted interior and exterior received signal values based upon a first learning rate; and a maintenance mode wherein said lock controller is configured to generate the adjusted interior and exterior received signal values based upon a second learning rate less than the first learning rate.

21. The lock assembly of claim 20 wherein said lock controller is configured to switch from the initial mode to the maintenance mode after a threshold number of touches of said touch sensor.

22. The lock assembly of claim 15 wherein said lock controller is configured to generate the adjusted interior received signal value and the adjusted exterior received signal value based upon at least one default received signal value.

23. The lock assembly of claim 15 wherein said lock controller is configured to operate in the automatic calibration mode based upon said touch sensor.

24. The lock assembly of claim 15 further comprising a radio frequency (RF) switch configured to permit said lock controller to selectively toggle said interior and exterior directional antennas to said wireless communications circuitry.

25. The lock assembly of claim 15 further comprising a manual calibration switch; and wherein said lock controller is also operable in a manual calibration mode responsive to said manual calibration switch.

26. The lock assembly of claim 15 wherein said lock controller is configured to receive authentication data along with signals received respectively by said interior and exterior directional antennas responsive to transmissions from the remote access wireless communications device.

27. A method of controller access in a wireless access control system comprising a remote access wireless communications device and a lock assembly to be mounted on a door remotely from the remote access wireless communications device, the lock assembly comprising a lock switchable between locked and unlocked positions, a door position sensor, interior and exterior directional antennas, lock wireless communications circuitry coupled to the interior and exterior directional antennas, a touch sensor, and a lock controller coupled to the lock, the door position sensor, the lock wireless communications circuitry, and the touch sensor, the method comprising:

using the lock controller to unlock the lock based upon the touch sensor to permit a user to open the door, determine when the door is closed after being opened based upon the door position sensor, determine whether the remote access wireless communications device is in an interior area or an exterior area based upon the interior and exterior directional antennas, switch the lock to the locked position when the door is closed and when the remote access wireless communications device is determined to be in the interior area, and not switch the lock to the locked position when the door is open;

the lock controller being further used to operate in an automatic calibration mode to generate an adjusted interior received signal value and an adjusted exterior received signal value based upon signals received respectively by the interior and exterior directional antennas responsive to transmissions from the remote access wireless communications device, and enable unlocking of the lock when the adjusted interior and exterior received signal values indicate the remote access wireless communications device is in the exterior area, and disable unlocking of the lock when the adjusted interior and exterior received signal values indicate the remote access wireless communications device is in the interior area.

28. The method of claim 27 wherein the lock controller is used to determine whether the remote access wireless device is in the exterior area or in the interior area based upon a difference between the adjusted interior and exterior received signal values.

29. The method of claim 27 wherein the lock controller is used to determine whether the remote access wireless communications device is in the exterior area or in the interior area based upon a difference between the adjusted interior and exterior received signal values exceeding a threshold.

30. The method of claim 27 wherein the lock controller is used to generate the adjusted interior received signal value based upon a plurality of prior received signals from the interior directional antenna, and generate the adjusted exterior received signal value based upon a plurality of prior received signals from the exterior directional antenna.

31. The method of claim 27 wherein the lock controller is used to generate the adjusted interior received signal value and the adjusted exterior received signal value to be within respective threshold limit values.

32. The method of claim 27 wherein automatic calibration mode comprises:

an initial mode wherein the lock controller generates the adjusted interior and exterior received signal values based upon a first learning rate; and a maintenance mode wherein the lock controller generates the adjusted interior and exterior received signal values based upon a second learning rate less than the first learning rate.

* * * * *